United States Patent [19]

Azuma

[11] 4,208,145

[45] Jun. 17, 1980

[54] NIB FOR WRITING INSTRUMENTS

[75] Inventor: Daisaburo Azuma, Yashio, Japan

[73] Assignee: Pentel Kabushiki Kaisha, Tokyo, Japan

[21] Appl. No.: 967,875

[22] Filed: Dec. 8, 1978

[30] Foreign Application Priority Data

| | | | |
|---|---|---|---|
| Dec. 17, 1977 | [JP] | Japan | 52-170377[U] |
| Jun. 23, 1978 | [JP] | Japan | 53-86227[U] |
| Aug. 14, 1978 | [JP] | Japan | 53-111371[U] |
| Nov. 28, 1978 | [JP] | Japan | 53-163695[U] |

[51] Int. Cl.[2] ..... B05C 21/00

[52] U.S. Cl. ..... 401/196; 401/264; 401/265

[58] Field of Search ..... 401/196, 198, 199, 148, 401/263, 264, 265

[56] References Cited

U.S. PATENT DOCUMENTS

| | | | |
|---|---|---|---|
| 2,282,406 | 5/1942 | Hollenbeck | 401/264 |
| 2,624,901 | 1/1953 | Wiley | 401/264 |
| 3,338,216 | 8/1967 | Roller, Sr. | 401/265 |
| 3,520,629 | 7/1970 | Otsuka | 401/265 X |
| 3,718,401 | 2/1973 | Kiriu | 401/265 |

*Primary Examiner*—John D. Yasko

*Attorney, Agent, or Firm*—Wenderoth, Lind & Ponack

[57] ABSTRACT

A planar type nib for writing instruments comprises a plurality of capillary ink feeding channels throughout the entire length of the nib. A split is formed at a tip portion of the nib so that the independent capillary ink feeding channels may be connected to one another at the tip portion of the nib when a writing pressure is applied to the nib.

15 Claims, 22 Drawing Figures

NIB FOR WRITING INSTRUMENTS

BACKGROUND OF THE INVENTION

The present invention relates generally to a stylus, or nib for writing instruments, such as fountain pen and the like, and more particularly to a synthetic resin nib of a planar, or plate-like type which can serve "bidirectional writing". The term "bidirectional writing" herein intends to mean that opposite surfaces of the nib can serve writing by changing a writing posture of the instrument.

It is widely known, as seen from a planar type pen, or stylus of a fountain pen, that liquid ink contained in a reservoir is fed along a pen surface to a tip of the pen.

Writing instruments of this type, however, are quite unsuitable particularly for fine work incapable of flooding as essential characteristics, because such writing instrument has a relatively wide area of exposed nibs.

Proposals have been made to avoid the defects and shortcomings while retaining the advantages of the type, in which a single ink feeding channel is formed within the nib so that ink is fed to the nib through the ink feeding channel. However, it has been found that the writing instrument of this type presents a rapid retreat of ink when the tip of the instrument, namely writing nib, is turned to face upward, resulting in a failure of a smooth and clear writing.

Accordingly, it is a primary object of the present invention to provide an improved nib for a writing instrument retaining certain advantages of the planar nib.

Another object of the present invention is to provide an improved nib in which any ink retreat does not come out.

Another object of the present invention is to provide a writing nib which permits a desired supply of ink to the writing point.

A further object of the present invention is to provide a nib for a writing instrument which serves a bidirectional writing.

SUMMARY OF THE INVENTION

Briefly, there is provided an improved nib for a writing instrument comprising a planar, or plane shaped, synthetic resin nib, which is fitted into a shroud of the writing instrument. The nib has a plurality of capillary ink feeding channels which are formed independent from one another. The nib has a split at the tip thereof so that the independent capillary ink feeding channels are connected to one another at the tip of the nib.

In preferred embodiment of the invention, the plural capillary ink feeding channels may be formed within a thin resin bar, which is then covered with a resin layer or coverage. In this case, it is preferred that a tip portion of the resin coverage is cut aslant to leave and expose the thin resin bar only at the tip portion.

A longitudinal protrusion or protrusions may be formed on the surfaces of the flat surface of combined structure of the thin resin bar and resin coverage in the lengthwise direction of the combined structure such that the protrusions are correctly positioned relative to a recess or recesses formed inside of a nib holder. Alternatively, recesses may be formed on the combined structure whereas protrusions are formed on the interior of the nib holder. Provision of such guide members, namely protrusion and recess, permits a regular positioning of the nib relative to the nib holder. Thus, the caipllary ink feeding channels are located at substantially axial position of the writing instrument.

If the capillary ink feeding channels are formed in predetermined shape in cross section, provision of the split which will connect the channels to one another will be conducted at ease, and smooth ink delivery may be achieved.

Other objects and features of the present invention will become apparent from the detailed description of the invention which will be made with reference to the accompanying drawings.

DETAILED DESCRIPTION OF THE INVENTION

Figure 1:
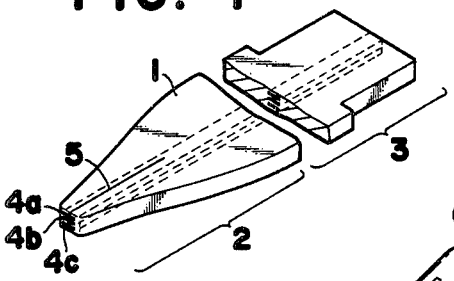
FIG. 1 is a partly fragmentary sectioned view of a nib for a writing instrument, embodying the present invention.
Figure 2:
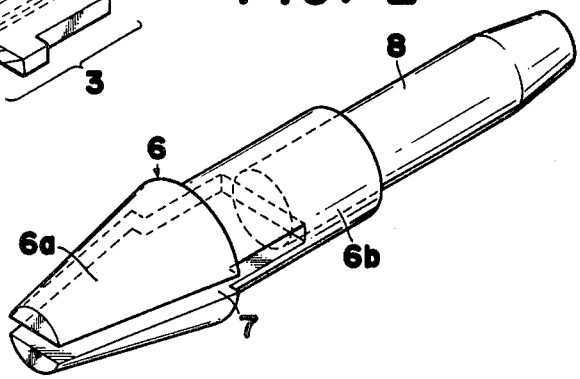
FIG. 2 is a perspective view of a nib holder which grasps the nib.
Figure 3:
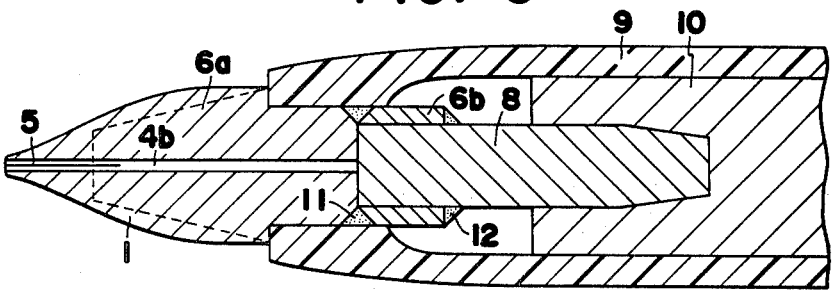
FIG. 3 is a transverse sectioned view of an assembled structure of the nib and nib holder shown in FIGS. 1 and 2.

Referring first to FIGS. 1, 2 and 3, a nib 1 which is made of synthetic resin is composed of a fore portion 2 and a rear portion 3. A plurality of capillary ink feeding channels 4*a*, 4*b*, and 4*c* are formed within, and through the total length of, the nib 1. These capillary ink feeding channels are independent from one another at the area of the rear porion 3 and are connected with one another at the tip area of the fore portion 2 by means of a split 5 which is formed at the tip area of the nib and will be described in detail with reference to FIGS. 4 and 5.

The nib 1 is inserted into a nib holder, which is illustrated generally by reference numeral 6 and is consisted with a frusto-conical section 6*a* and a cylindrical section 6*b*, the both sections being fabricated in integral. The nib holder 6 has a slit 7 which extends from an end of the frusto-conical section 6*a* to a middle portion of the cylindrical section 6*b*. The nib 1 is snugly fitted into the slit 7.

In FIG. 3 which shows the nib 1 assembled with other parts of the instrument, the rear end of the nib 1 is in intimate contact with an intermediate core 8 which comprises a flexible bundle of fibers or filaments. The nib holder 6 to which the nib is inserted is press-fitted into a tubular shroud 9 to form a substantial contour of the writing instrument. As best shown in FIG. 3, the intermediate core 8 is contacted with an ink reservoir 10 formed within the tubular shroud 10. Thus, the ink feeding channels 4*a* through 4*c* of the nib 1 are connected indirectly with the ink reservoir 10 through the intermediate capillary feeding core 8 which is made of multiplicity of fibers or filaments to provide a caipllary ink feeding system for feeding ink to the exposed writing nib 1 by capillary action. The nib 1 is hermetically sealed with the nib holder at position 11, and the nib holder 6 is hermetically sealed with the intermediate core 8 at 12 by means of solvent welding, calking or the equivalent. The ink reservoir 10, which is known in the art, may be of any suitable type, and may be of cartridge type.

Provision of the intermediate core 8 serves a sort of buffer or cushioning effect in the delivery of ink, thereby permitting a smooth feeding of ink to the writing nib. If desired, however, the intermediate core 8 may be replaced by a structure in which the rear portion 3 of the nib is extended to such an extend that same be contacted directly with the ink reservoir 10.

The plate-shaped writing nib may be made of any desired synthetic resins. This material may consist of a wide variety of substances well known to the art, such as polyacetal resins which have advantageous characteristics in abrasion quality and sliding property.

The synthetic resin product containing therein a plurality of capillary ink feeding channels may be fabricated by a known extrusion method by utilizing dies peculiar to the nib of the invention. For example, molten resin is melt-extruded from orifices of the dies, the orifices being formed in a predetermined pattern. When the molten resin is extruded, there occurs a phenomenon in which some number of extruded filaments are connected mutually whereas the other extruded filaments are not connected to one another. Thus, capillary ink feeding channels are formed by these non-connected filaments.

Figure 4:
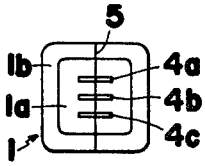
FIGS. 4 and 5 are end views of the nib embodying the present invention.

Preferably, a thin resin bar 1*a* which has a plurality of capillary ink feeding channels 4*a*–4*c* therein is formed by an extrusion die, and the extruded product is then coated with suitable syntheic resins, which may advantageously be formed of polyacetal resins, to form a closure or coverage 1*b* while the extruded product is being extended, as shown in FIG. 4. In this case, the thin resin bar 1*a* may be formed larger than the dimension of actual use, and then extended to obtain predetermined dimensions. The extension process provides the formed product with a desired strength and improvement in abrasion quality, and permits easy provision or formation of capillary ink feeding channels 4*a*–4*c* in a desired pattern.

Figure 5:
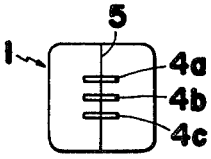

In order to obtain a final shape of the nib as illustrated in FIG. 1, a tip portion of the nib 1 is cut aslant so that a thin layer of the coverage 1*b* is left and surrounds the thin resin bar 1*a* at a writing tip of the nib (FIG. 4). Provision of the coverage 1*b*, however, is not necessarily needed if the plate-shaped nib can be directly extruded at the same time of forming the capillary ink feeding channels. The thus formed plate-shaped nib having the capillary ink feeding channels is then subject to a process of ground-finish to obtain a writing tip of the nib as shown in FIG. 5, which is not surrounded by the thin layer of coverage.

The split 5 formed at the tip portion of the nib 1 is substantially closed when not in use of the writing instrument, and the capillary ink feeding channels 4*a*–4*c* which are independed at the rear portion 3 of the nib remain independent at the fore portion 2 of the nib because no pressure for writing is applied to the nib 1. Further, size or dimensions of the ink feeding channels 4*a*–4*c* are selected so that ink does not retreat to the ink reservoir but sustains within the channels when the writing instrument is positioned upside down. When in use, the split 5 is opened by writing pressure to establish a connection of each of the capillary ink feeding channels. Thus, ink can be delivered to a writing surface of the nib constantly.

Figure 6:
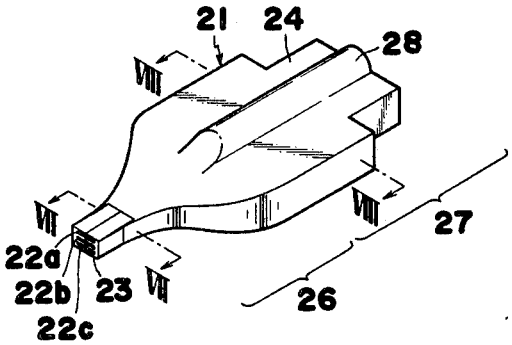
FIG. 6 is a perspective view of a nib in another embodiment of the present invention.
Figure 7:
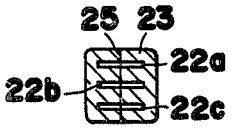
FIG. 7 is an enlarged sectioned view of the nib taken along VII—VII of FIG. 6.
Figure 8:
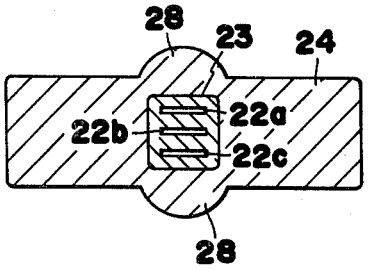
FIG. 8 is an enlarged sectioned view of the nib taken along VIII—VIII of FIG. 6.

Referring now to FIGS. 6, 7 and 8, which show a nib structure in accordance with another embodiment of the invention, a planar type nib 21 comprises a thin resin bar 23 containing capillary ink feeding channels 22*a*, 22*b* and 22*c*, and a coverage 24. The thin resin bar 23 has a split 25 at a tip portion of the nib so that the capillary ink feeding channels, which are independent from one another, are connected to one another at the tip of the nib. The nib is composed of a fore portion 26 and rear portion 27. Further, there is provided, at the rear portion 27, a longitudinal protrusion 28 on the central surface of the coverage 24 so that the protrusion 28 is coordinated with the resin bar 23. The nib 1 in this embodiment is so formed that the fore portion 26 is cut aslant to remove the coverage 24 and protrusion 28, as best shown in FIG. 6. It will be understood from FIG. 7 that the tip of the nib 21 is cut aslant to remove the coverage 24, retaining the thin resin bar 23. Thus, the thin resin bar 23 is exposed at the tip portion of the nib.

Figure 9:
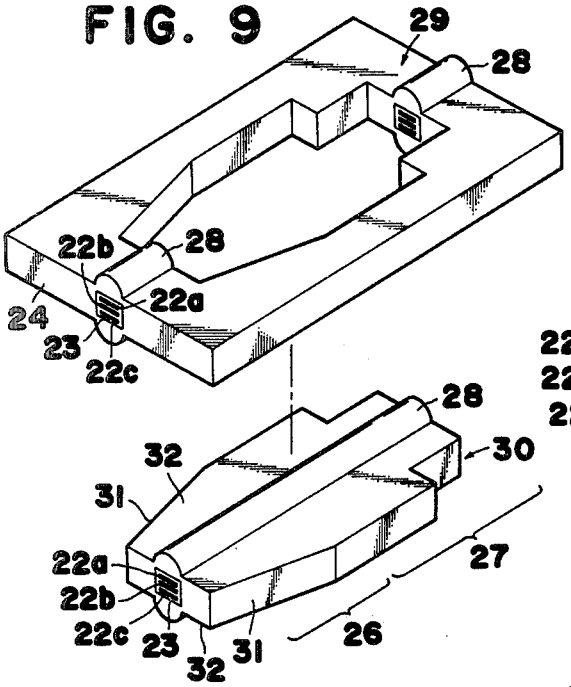
FIG. 9 is a perspective view of the nib illustrated in FIG. 6, showing a method of producing same.
Figure 10:
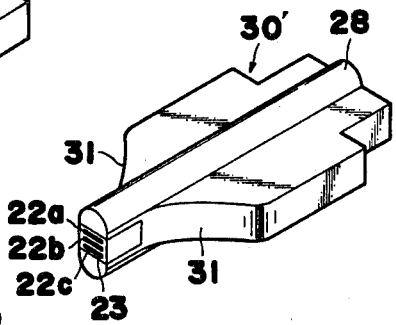
FIG. 10 is a perspective view of a nib in another embodiment of the invention.

The nib 21 of this embodiment is formed in such a manner that molten resin is extruded through a die which has a groove of rectangular cross sectional shape, and at the same time the prefabricated thin resin bar 23 is pulled maintaining the bar 23 in a central position of the extruded resin. A care should be taken in this procedure that the thin resin bar 23 is correctly positioned at the center of the groove of the extrusion die. The thus formed resin structure, which is shown by reference numeral 29 in FIG. 9, is punched to form a nib body 30 in a desired shape. The punched nib body 30 is then subject to a grinding step, and a split 25 (FIG. 7) is formed at the tip portion of the nib. In the grinding step the elongated protrusions 28 are cut out at the fore portion 26 so that the protrusions retain at the rear portion 27, and sides and surfaces are ground to obtain a desired final shape. The aforementioned resin structure 29 may possibly be punched to form a nib body 31 as shown in FIG. 10, which does not require to be ground at the side portions. The nib body 31 is then cut aslant at the surfaces of the fore portion 26.

The shape and dimensions of the nib are shown in exaggerated and greatly amplified scale to facilitate an understanding of the construction, a fact of which will be appreciated that exterior or outer diameter of the thin resin bar 23 is about 0.8 mm, and the coverage 24 has a thickness of about 1.0 mm and width of about 4 mm. Both of the thin resin bar and the coverage are preferably made of polyacetal resin.

Figure 11:
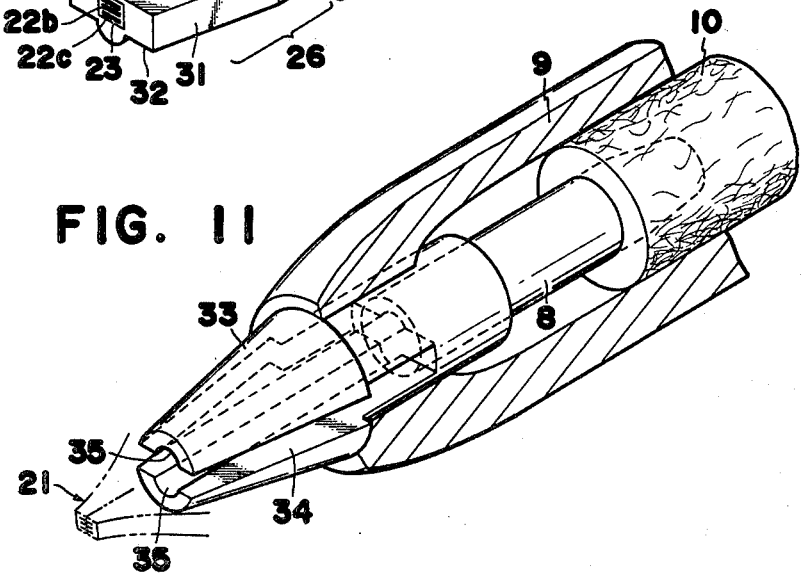
FIG. 11 is a partly sectioned and fragmented perspective view of a writing instrument, showing that the nib of FIG. 6 is to be assembled.

The nib 21 having protrusions 28 is inserted into a nib holder 33, as illustrated in FIG. 11. The nib holder 33 for grasping the nib 21 of the type shown in FIG. 6 has a structure similar to that of FIG. 2 but further comprises grooves 35 for securing therein the longitudinal protrusions 28 of the nib. Other elements in FIG. 11 such as intermediate core 8, cylindrical shroud 9, ink reservoir 10, slit 34 are similar to those of FIG. 3, and a detailed description thereabout is not made.

Figure 12:
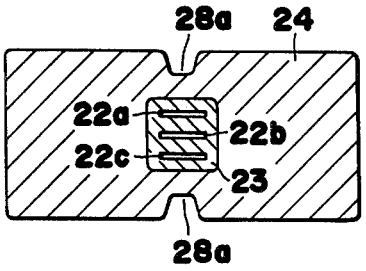
FIG. 12 is a sectioned view of a nib in accordance with another embodiment of the invention.

In FIG. 12 which shows a modified structure of the nib, in which a longitudinal recess or groove 28*a* are formed on the surfaces of the coverage 24, in place of the longitudinal protrusions 28 which has been described with reference to FIGS. 6–10. It would apparently be understood that the nib holder 6 or 33, when the nib 24 of FIG. 12 is in use, comprises projections, not shown, at the inside of the slitted surface so that the projections be fitted to the grooves 28*a* of the nib. If needed from a viewpoint of design, projection 28 or groove 28*a* may be formed on either upper or lower surface of the coverage 24, but applicants have found that provision of these guide members, i.e., projections 28, on the both surfaces of the coverage 24 has presented an advantage that the coverage 24 can be readily and firmly fixed to the thin resin bar 23.

The writing nib 21, as described above, has guide members such as protrusions 28 or grooves 28*a* right above and below the position of the thin resin bar 23. Therefore, the guide members can serve as a basis for a punching operation shown in FIG. 9 and, cutting-aslant operation for forming a desired shape of the nib as shown in FIG. 6. The finished product of the nib has a plurality of capillary ink feeding channels 22*a*, 22*b*, 22*c* which are located at substantially central position of the nib. Thus, the channels are positioned at the center of the tip of the nib. Besides, the guide members, protrusions 28 or grooves 28*a*, facilitate a correct positioning of the nib within the nib holder 33. Furthermore, the guide members 28 and 28*a* serves to prevent the nib from moving or sliding laterally when a lateral pressure is added to the nib because the guide members are snugly contacted with the nib holder. In addition to the above, the protrusions 28, which is cut out at the fore portion and remained at the rear portion, give a suitable stiffness or rigidity to the rear portion and a suitable resiliency to the fore portion. Therefore, a nib having a desired resiliency at its tip can be obtained.

Figure 13A:
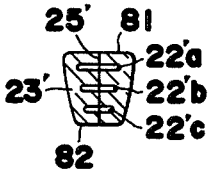
FIGS. 13A and 13B are sectioned views of a nib in accordance with other embodiments of the invention.
Figure 13B:
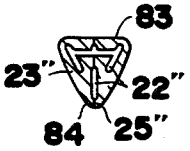

FIGS. 13A and 13B show a cross sectional shape of the nib in modification of the nib structure shown in FIG. 7. In FIG. 13A, the tip of the nib, namely the thin resin bar 23', is a trapezoidal in cross section and has a longer side 81 and a shorter side 82. In compliance with the trapezoidal shape of the thin resin bar, capillary ink feeding channels 22'*a*, 22'*b*, 22'*c* are formed such that the channel 22'*a* adjacent the longer side 81 is larger, or longer in a cross sectional shape whereas the channel 22'*c* adjacent the shorter side 82 is smaller, or shorter in a cross section shape. In the drawing, reference numeral 25' represents a split which is quite similar with that of the previous-disclosed embodiments. The trapezoidal tip of the nib permits drawing of broader lines by contacting the longer side 81 with the writing paper and finer lines by the shorter side 82. The larger channel 22'*a* adjacent the longer side 81 complies with quantity of ink for writing broader lines, and the smaller channels 22'*c* adjacent the shorter side 82 is suitable for feeding ink for writing fine lines. If an extremely fine line is appreciated, cross sectional shape of the resin bar may be formed as illustrated in FIG. 13B, in which a thin resin bar 23" is constructed to be substantially triangular. A side 83 permits a drawing of broad lines and an edge portion 84 an extremely fine lines. In FIG. 13B, reference numerals 22" and 25" represent capillary ink feeding channels and split, respectively.

Figure 14:
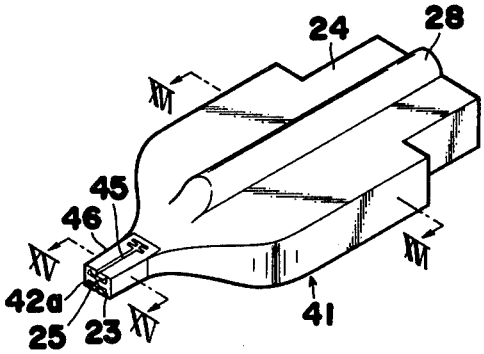
FIG. 14 is a perspective view of a nib of another embodiment of the invention.
Figure 15:
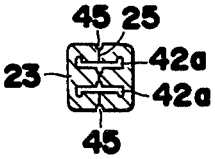
FIGS. 15 and 16 are sectioned views of the nib shown in FIG. 14, taken along XV—XV and XVI—XVI, respectively.
Figure 16:
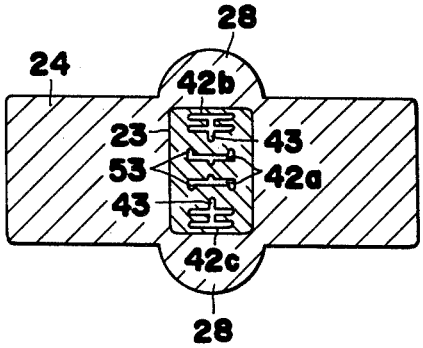

FIGS. 14, 15 and 16 show a modified type of the writing nib which has been described with reference to FIGS. 6, 7 and 8. Elements in this modified type are substantially similar with those of the elements shown in FIGS. 6–8, and a detailed description will not be made with respect to each of the elements. A nib 41 of this embodiment shown in FIGS. 14–16 contains a thin resin bar 23 which has two central capillary ink feeding channels 42*a* at a center portion of the thin resin bar 23, upper channel 42*b* and lower channel 42*c*. The upper and lower channels 42*b*, 42*c* have vertical channel portions 43 extending toward the center of the thin resin bar. Further, the central channels 42*a* have vertical channel portions, which are generally illustrated at 53. The vertical channel portions 53 of the centrl channels 42*a* effectively prevent the central channels from being crushed or narrowed by writing pressure added to the nib.

Figure 17A:
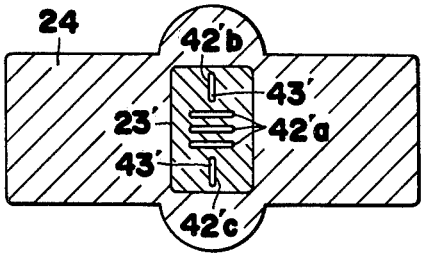
FIGS. 17A and 17B are sectioned views of a nib in accordance with other embodiments of the invention.
Figure 17B:
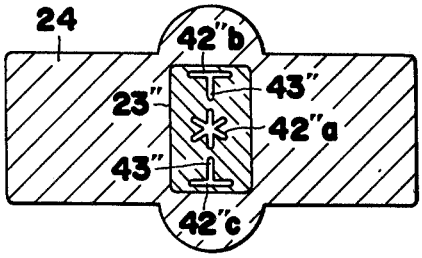

Through the writing nib shown in FIGS. 14–16 comprises two capillary ink feeding channels 42*a* at the central portion of the thin resin bar 23, shape and number of the capillary ink feeding channels may be modified. For example, FIG. 17A shows a modified structure in which three capillary ink feeding channels 42'*a*, each of which is longitudinal in section, are disposed at the central portion of the thin resin bar 23'. FIG. 17B shows a further modified structure in which a single capillary ink feeding channel 42"*a*, which is star shaped in section, is disposed at the central portion of the thin resin bar 23".

Figure 18:
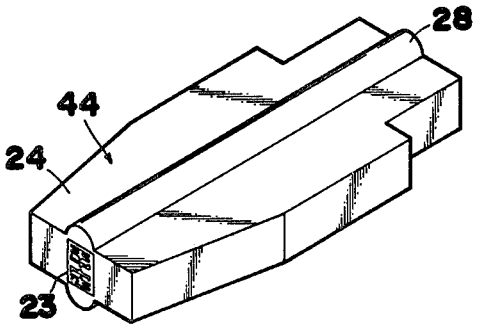
FIG. 18 is a perspective view of a nib body from which the nib of FIG. 14 is formed.

Referring again to FIGS. 14–16, upper channel 42*b* and lower channel 42*c* are disposed in such a form as illustrated in FIG. 16. These channels may be modified to the structure of channels 42'*b*, 42'*c* as shown in FIG. 17A, or channels 42"*b*, 42"*c* of T-shaped structure as shown in FIG. 17B. It is preferred that the ink feeding channels are formed in a symmetrical fashion relative to a vertical central line of the thin resin bar 23. The nib shown in FIG. 14 may be fabricated by the method as previously described with reference to FIG. 9 to form a nib body 44 shown in FIG. 18. The nib body 44 is cut aslant at the fore portion thereof to obtain the structure shown in FIG. 14, in which the central grooves 42*a* are extensively seen at the tip of the nib whereas a part of the upper and lower channels 42*b*, 42*c*, are seen at the sides of the tip. The part 43 of the upper and lower channels are seen as grooves 45 at the cut-aslant area 46 of the nib, as illustrated in FIG. 14. Namely, the nib is cut aslant to an extent that only a part of vertical channel portions 43 of the upper and lower channels 42*b*, 42*c* is exposed on the cut-aslant area in the form of a groove 45.

It will be understood from FIG. 16 that the upper and lower channels 42*b*, 42*c* are retained in a complete form within the remanent rear portion, namely not cut-aslant portion, of the nib. Further, it would be understood that the finished nib is snugly fitted to a nib holder which is similar in structure with that of FIG. 11.

Figure 19:
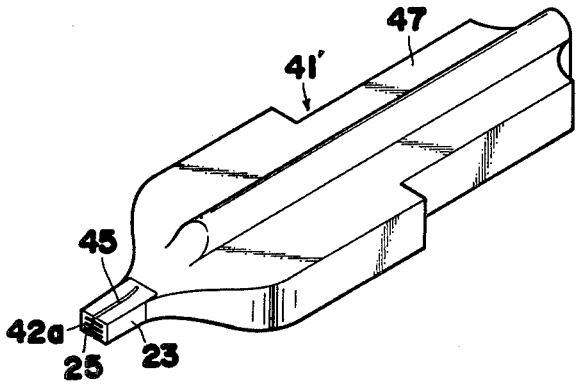
FIG. 19 is a perspective view of a nib in accordance with another embodiment of the invention.

FIG. 19 shows a modified type of the nib, in which the nib 41' is extended at its rear portion 47 to an extent that the extended rear portion 47 is in familiar contact with the ink reservoir 10 without the intermediate core 8 shown in FIGS. 3 and 11. The structure of this nib 41' in the embodiment of FIG. 19 permits a direct contact with the ink reservoir 10. The other elements such as resin bar 23, split 25, central channels 42*a*, groove 45 and a cut-aslant structure are substantially similar with those of the elements and structure of FIGS. 14–16, and no detailed description will be made.

In various structures of the nib illustrated in FIGS. 14–19, the upper and lower channels are exposed in the shape of grooves at the tip portion as illustrated. The grooves 45 permit a reliable provision of the vertical split 25 by slighty contacting an edged tool to the groove 45 since resin molecular orientation of the thin resin bar 23, 23', 23" occurs in the lengthwise direction of the bar when the bar is formed by the extension method. If desired, the split 25 may be formed, without using any tool, by simply applying a suitable pressure to the grooved structure from opposite directions. The length of the split is readily limited to the position where the coverage 24 exists and does not extend any further. Therefore, any tool or instrument for limiting the extension of the split will not be needed. The grooves 45 serve as an ink pool which facilitates, solely or in combination with the split, ink feeding to the tip of the nib.

Figure 20:
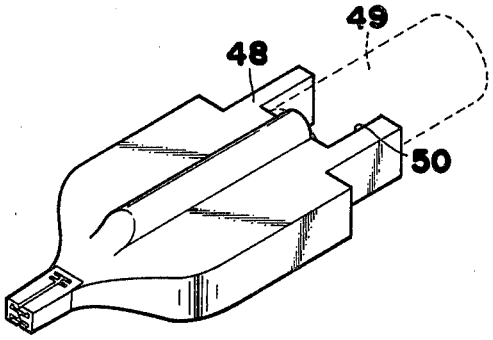
FIG. 20 is a perspective view of a nib in accordance with another embodiment of the invention.

FIG. 20 shows a further modified type of the nib, in which the nib has a recess 50 at the rear end 48 thereof for holding the aforementioned intermediate core 49. This modified type of the nib has an advantage that a further reliable capillary ink feeding action of the nib can be realized since the length of the capillary ink feeding channels disposed within the nib may be minimized.

While the particular nib of writing instrument herein shwon and disclosed in detail is fully capable of attaining the objects and providing the advantages hereinbefore stated, it is to be understood that it is merely illustrative of the presently preferred mebodiments of the invention and that no limitations are intended to the details of construction or design herein shown other than as defined in the appended claims.

What is claimed is:

1. A nib for a writing instrument wherein said instrument comprises a nib holder, a tubular shroud and an ink reservoir within said tubular shroud, said nib being plate-like and comprising therein a plurality of capillary ink feeding channels throughout the entire length of said nib and a split at a tip portion thereof, said capillary ink feeding channels being connected to one another at said tip portion by means of the split when writing pressure is applied to said nib.

2. The nib for a writing instrument according to claim 1, in which said nib is composed of a resin bar and a resin layer which covers said resin bar, said capillary ink feeding channels being disposed within said resin bar.

3. The nib for a writing instrument according to claim 2, in which said nib is cut aslant to remove said resin layer at said tip portion of the nib such that said resin bar is exposed at said tip portion.

4. The nib for a writing instrument according to claim 3, in which said resin bar is formed trapezoidal in section.

5. The nib for a writing instrument according to claim 4, in which said resin bar has a first side and a second side, said first side being longer than said second side, said capillary ink feeding channels being formed such that the channels adjacent said first side being larger in cross sectional area than the channels adjacent said second side.

6. The nib for a writing instrument according to claim 3, in which said resin bar is triangular in section.

7. The nib for a writing instrument according to claim 3, in which said nib comprises guide means on the center of said resin layer, said guide means being formed coordinated in position with said resin bar.

8. The nib for a writing instrument according to claim 7, in which said guide means is disposed on a surface of said plate-like nib.

9. The nib for a writing instrument according to claim 7, in which said guide means is disposed on upper and lower surface of said plate-like nib.

10. The nib for a writing instrument according to claim 7, in which said guide means is consisted with an elongated convex.

11. The nib for a writing instrument according to claim 7, in which said guide means is consisted with an elongated concave.

12. The nib for a writing instrument according to claim 3, in which said capillary ink feeding channels contain a first channel group disposed at a central portion of said resin bar, a second channel group disposed above said first channel group and a third channel group disposed below said first channel group, said second and third channel groups each having a channel portion extending toward said first channel group, said channel portion being exposed in the shape of a groove at the tip portion of said nib.

13. The nib for a writing instrument according to claim 12, in which said capillary ink feeding channels are formed symmetrical relative to a vertical central line of said resin bar.

14. The nib for a writing instrument according to claim 1, in which said nib has a rear portion extending to be in direct contact with said ink reservoir.

15. The nib for a writing instrument according to claim 1, in which said nib has a recess at a rear portion thereof for snugly inserting therein an intermediate capillary system, said system being disposed between said nib and said ink reservoir.

* * * * *